US008203128B2

(12) United States Patent
Nishikawa

(10) Patent No.: US 8,203,128 B2
(45) Date of Patent: Jun. 19, 2012

(54) RADIATION SOURCE CONTAINER AND METHOD OF EXTENDING THE SEALING LIFE OF A RADIATION SOURCE CAPSULE ACCOMMODATED IN THE RADIATION SOURCE CONTAINER THEREOF

(75) Inventor: Masamitsu Nishikawa, Saitama-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 163 days.

(21) Appl. No.: 12/715,734

(22) Filed: Mar. 2, 2010

(65) Prior Publication Data

US 2010/0224800 A1 Sep. 9, 2010

(30) Foreign Application Priority Data

Mar. 5, 2009 (JP) ..... 2009-052614

(51) Int. Cl.
*G21F 5/12* (2006.01)

(52) U.S. Cl. ..... 250/506.1; 250/505.1; 250/496.1

(58) Field of Classification Search ..... 250/506.1, 250/493.1, 496.1, 505.1, 497.1, 498.1
See application file for complete search history.

(56) References Cited

U.S. PATENT DOCUMENTS 6,452,200 B1 * 9/2002 Kotler ..... 250/506.1

* cited by examiner

*Primary Examiner* — Kiet T Nguyen
(74) *Attorney, Agent, or Firm* — Oblon, Spivak, McClelland, Maier & Neustadt, L.L.P.

(57) ABSTRACT

A radiation source container comprising: a radiation source capsule (1); a radiation source holder (4) having an aperture (B) that emits unidirectionally radiation emitted from a radiation port A of the radiation source capsule, that provides screening such that no leakage of radiation takes place except from this aperture, and that fixes this radiation source capsule (1) in a manner that is difficult to attach or detach; a container (7) that accommodates the radiation source holder (4) and that has an irradiation window (C) that transmits radiation emitted from the aperture; an attenuation plate (3) provided between the radiation port of the radiation source capsule and the irradiation window, that attenuates beforehand the amount of radiation emitted; a shutter (6) provided between the attenuation plate (3) and the irradiation window (C) and that screens the radiation emitted from the irradiation window; and a capsule cover whereby, when the recommended use period in respect of the sealing performance of the radiation source capsule (1) has expired, the attenuating plate (3) is removed and the radiation port of the radiation source capsule (1) is resealed with the same material properties and the same thickness as the attenuating plate (3).

4 Claims, 4 Drawing Sheets

(a)

(b)

(a)

(b)

(c)

RADIATION SOURCE CONTAINER AND METHOD OF EXTENDING THE SEALING LIFE OF A RADIATION SOURCE CAPSULE ACCOMMODATED IN THE RADIATION SOURCE CONTAINER THEREOF

CROSS-REFERENCE TO RELATED APPLICATION

This application claims benefit of priority from Japanese application number JP 2009-52614 filed Mar. 5, 2009, the entire contents of which are incorporated by reference herein.

BACKGROUND OF THE INVENTION

1. Field of the Invention

The present invention relates to a radiation source container that accommodates a radiation source capsule in which a radiation source is sealed, and to a method of extending the sealing life of a radiation source capsule accommodated in the radiation source container.

2. Description of the Related Art

Measurement equipment employing radiation to measure for example the thickness, level, density or water content of a measurement subject by measurements utilizing radiation is known. Also, regarding the various types of such devices utilizing radiation, safety standards in relation to sealing of the radiation source are laid down in Japanese Standard JIS Z4821 and safety standards regarding the radiation source container that accommodates the sealed radiation source are laid down in Japanese Standard JIS Z4614, respectively. Examples are to be found in: Technical Explanation of Measurement Equipment Utilizing Radiation [online], 2007, Japan Electric Measuring Instruments Manufacturers' Association Inc [retrieved 29 Jan. 2009] Internet <URL: http://www.jemima.or.jp/> (hereinbelow referred to as non-patent reference 1).

A conventional radiation source container using γ rays as the radiation source in accordance with these standards will now be described with reference to FIG. 1A and FIG. 1B. FIG. 1A is a plan view of a conventional radiation source container 100 in a condition with the container lid 7*b* removed from the direction of the top; FIG. 1B is a cross-sectional view seen from the direction of the broken line arrows Xa-Xb of FIG. 1A.

In FIG. 1A and FIG. 1B, the radiation source container 100 comprises a radiation source capsule 1 that emits γ rays and that is hermetically sealed with metal such as stainless steel, a radiation source holder 4 that accommodates this radiation source capsule 1, having an aperture B that emits γ rays emitted from an radiation port A in the middle of the top of the radiation source capsule 1 unidirectionally and whereby screening is effected such that γ rays cannot leak except from this aperture B, and on which holder this radiation source capsule 1 is fixed in such a manner that it is difficult to attach or detach, and a radiation source holder accommodating container 7 that accommodates the radiation source holder 4.

This radiation source holder accommodating container 7 comprises a radiation source holder accommodating container lid 7*b* having an irradiation window C provided with a window plate 7*b*1 formed of a metal plate, such as aluminum, that is transparent to γ rays, and a radiation source holder accommodating container main unit 7*a* of this radiation source holder accommodating container lid 7*b*: γ rays are emitted from this irradiation window C.

The radiation source holder accommodating container 7 further comprises, in its interior, an electrically operated shutter 6 that is operated by a control signal from outside, and a manually operated shutter 5 that is operated by hand so as to screen emitted γ rays from the irradiation window C provided between the radiation port A of the radiation source capsule 1 and the irradiation window C.

In more detail, the radiation source holder 4 comprises a capsule fixing member 2*a* comprising a lid 2*a*1 and a seat 2*a*2 whereby the radiation source capsule 1 is fixed in the interior of this radiation source holder 4, a holder side plate 4*a* with a lead plate stuck thereon so as to prevent leakage of γ rays from outside the aperture B, and a holder base plate 4*b*.

Also, when the radiation source container 100 is stored or transported, the manually operated shutter 5 is manually operated to operate a screening plate 5*a* made of a lead plate or tungsten plate, to effect screening so that there is no leakage of γ rays emitted from the aperture B.

When the radiation source container 10 is incorporated in a measuring instrument employing radiation, the electrically operated shutter 6 controls whether or not other control devices constituting the measuring instrument employing radiation are subjected to irradiation or screened therefrom; in this electrically operated shutter 6, a screening plate 6*d* made of a lead plate or tungsten plate is mounted on a mounting base 6*c*; the mounting base 6*c* is mounted on a rotary shaft of a rotary solenoid 6*b* and is rotated by this rotary solenoid (coil) 6*b*; emission of γ rays from the aperture B is controlled by opening/closing the screening plate 6*d*; irradiation of outside the radiation source holder accommodating container 7 by γ rays from the irradiation window C is thereby controlled.

The radiation source capsule 1 accommodated in the radiation source container 100 constructed in this way is usually sealed by welding in a stainless steel capsule; however, the manufacturers of the radiation source capsule 1 recommend that the period of use of this welded seal should be no more than about 15 years; if the radiation source container is to be used for more than this, replacement of the radiation source capsule 1 is recommended.

Also, techniques have been disclosed for improving the performance of a level meter employing such γ rays. An example is to be found in Japanese Patent Number 3063488 (hereinbelow referred to as patent reference 1).

However, in the case of $^{241}$Am (radiation source), the half-life is 432 years and even in the case of $^{137}$Cs (radiation source) the half-life is 30 years. Thus, from the point of view of the half-life of the radiation source, it would be possible to employ the radiation source container for longer than the recommended period of use of the welded seal. Thus, replacing the radiation source capsule within the recommended period of use of the welded seal presents the problems not only that the task of replacing each one of devices that are employed in large quantity is considerable, but also that of wastefully discarding radiation capsules.

Consideration has therefore been given to employing the radiation sources for longer by improving the recommended period of use of the seal by re-doing the welded seal of the entire radiation capsule. However, such recycled capsules are subject to the problem that the amount of radiation is reduced so that the initial amount of radiation cannot be obtained, and also the problem that the guarantee of sealing is unreliable, so that a product of low reliability is obtained.

SUMMARY OF THE INVENTION

The present invention was made in order to solve the above problems, its object being to provide a radiation source container and method of extending the sealing life of a radiation source capsule accommodated in this radiation source container whereby an extended life of the radiation source capsule can easily be achieved, without needing to replace the radiation source capsule at the recommended period of use in regard to the welded seal of the radiation source capsule.

In order to achieve the above object, a radiation source container according to the present invention is constructed as follows. Specifically, a radiation source container comprises:

a radiation source capsule;

a radiation source holder having an aperture that emits unidirectionally radiation emitted from a radiation port of before-mentioned radiation source capsule, that provides screening such that no leakage of radiation takes place except from this aperture, and that fixes this radiation source capsule in a manner that is difficult to attach or detach;

a radiation source holder accommodating container that accommodates before-mentioned radiation source holder and that has an irradiation window that transmits radiation emitted from before-mentioned aperture;

an attenuation plate provided between the radiation port of before-mentioned radiation source capsule and before-mentioned irradiation window, that attenuates beforehand the amount of radiation emitted from before-mentioned irradiation window;

a shutter provided between before-mentioned attenuation plate and before-mentioned irradiation window and that screens the radiation emitted from before-mentioned irradiation window; and a capsule cover whereby, when the recommended use period in respect of the sealing performance of before-mentioned radiation source capsule has expired, before-mentioned attenuating plate is removed and the radiation port of before-mentioned radiation source capsule is resealed with the same material properties and the same thickness as before-mentioned attenuating plate, covering this entire radiation source capsule.

In addition, in order to achieve the above object, a method of extending the sealing life of a radiation source capsule of a radiation source container according to the present invention comprises the following steps. Specifically, a method of extending the sealing life of a radiation source capsule that seals a radiation source accommodated in a radiation source container comprises:

a step of providing before-mentioned attenuating plate that produces attenuation beforehand so as to present a value corresponding to the amount of attenuation of the amount of radiation emitted from the irradiation window of before-mentioned radiation source container in the recommended period of sealing use of before-mentioned radiation capsule; and a step of when the recommended use period in respect of the sealing performance of before-mentioned radiation source capsule has expired, removing before-mentioned attenuating plate and resealing the radiation port of before-mentioned radiation source capsule with the same material properties and the same thickness as before-mentioned attenuating plate, covering this entire radiation source capsule.

With the present invention, a radiation source container that accommodates a radiation source capsule and method of extending the sealing life of its radiation source capsule is obtained whereby an extended life of the radiation source capsule can easily be achieved, without needing to replace the radiation source capsule at the recommended period of use in regard to the welded seal of the radiation source capsule.

DETAILED DESCRIPTION OF THE PREFERRED EMBODIMENTS

An embodiment of the present invention is described below with reference to the drawings.

Embodiment

A radiation source container 10 will now be described with reference to FIG. 2A, FIG. 2B and FIG. 2C to FIG. 4. Portions in the embodiment shown in FIG. 2A, FIG. 2B and FIG. 2C that are the same as in the conventional container shown in FIG. 1A and FIG. 1B are given the same reference symbols and further description thereof is dispensed with.

Figure 1A:
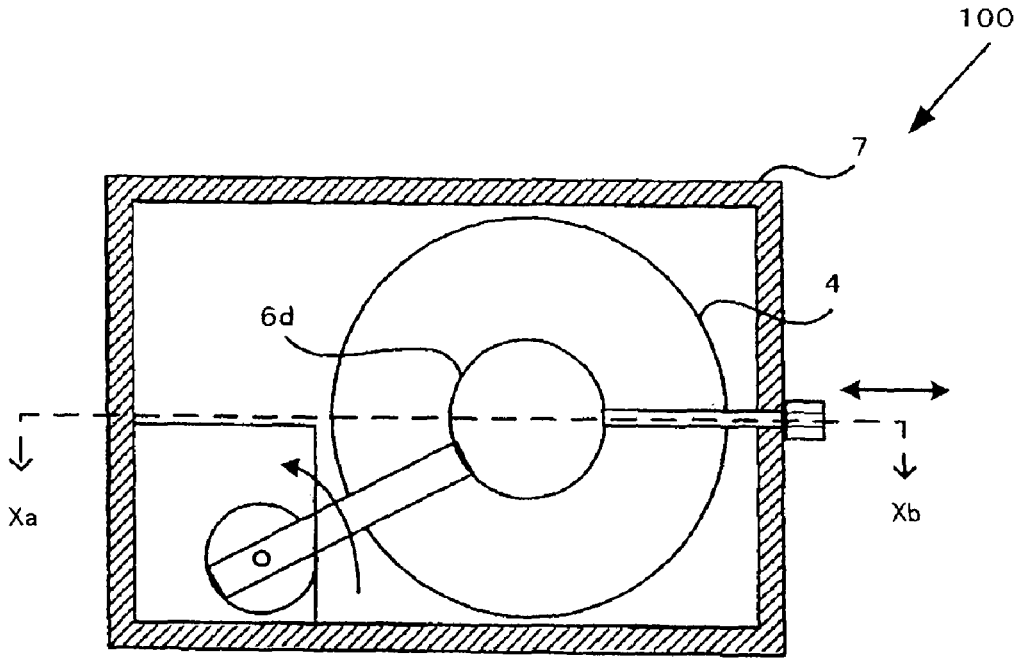
FIG.1A(PRIOR ART)
FIG. 1A and FIG. 1B are layout diagrams of a conventional radiation source container, specifically, a plan view and a front face cross-sectional view.
Figure 1B:
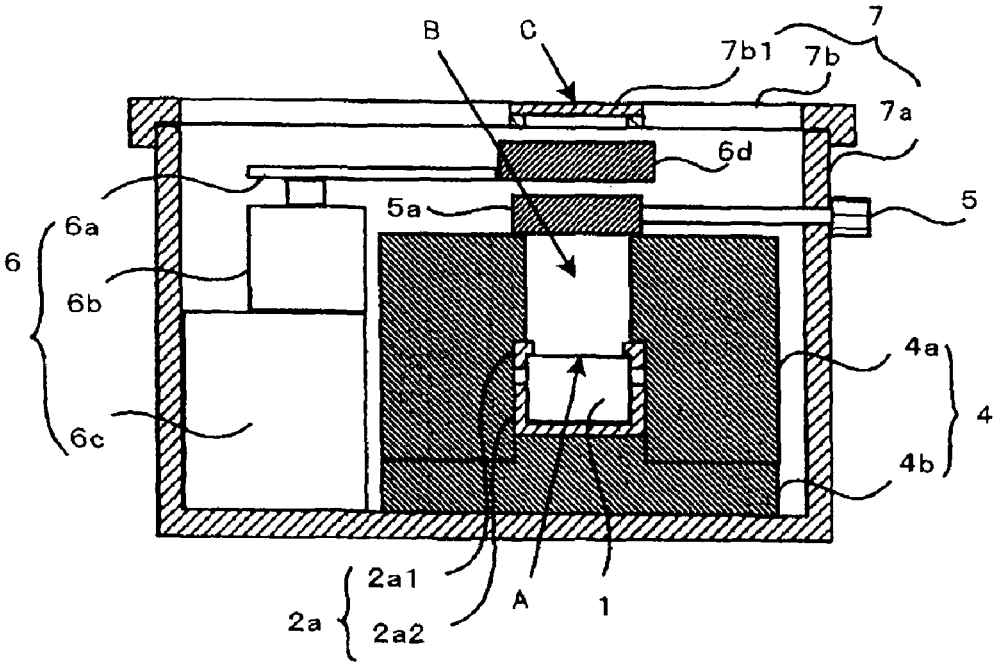
FIG.1B(PRIOR ART)
Figure 2A:
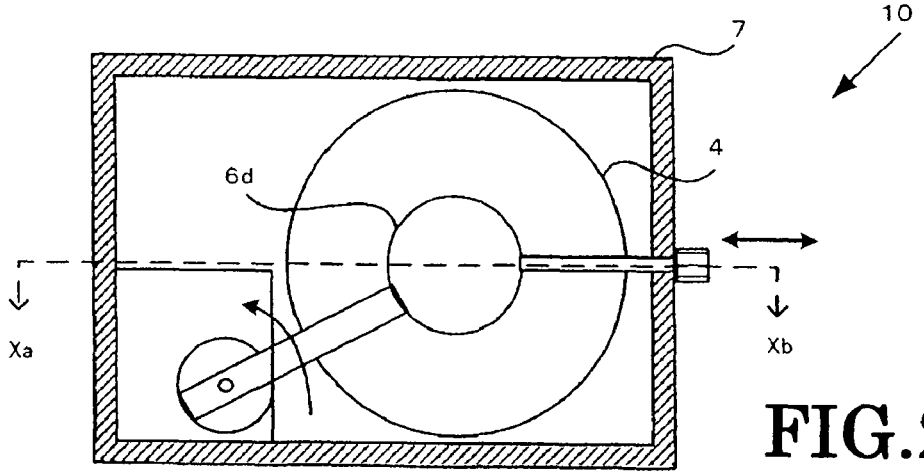
FIG. 2A, FIG. 2B and FIG. 2C are layout diagrams of a radiation source container according to the present invention, specifically, a plan view, a front face cross-sectional view and a front face cross-sectional view.
Figure 2B:
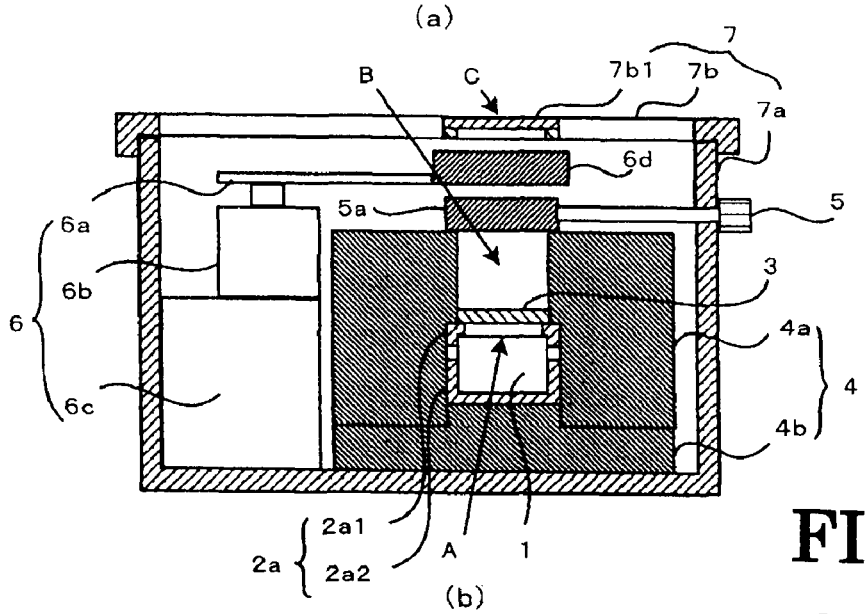
Figure 2C:
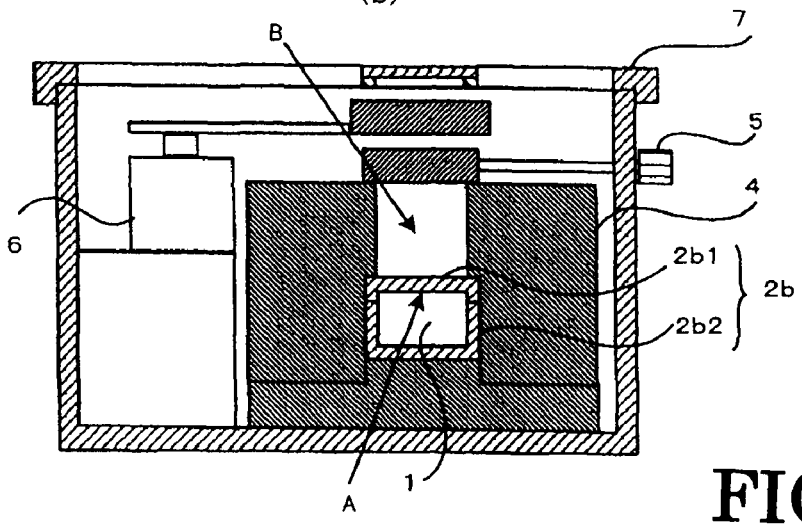

The points of difference of the embodiment shown in FIG. 2A, FIG. 2B and FIG. 2C compared with the conventional construction shown in FIG. 1A and FIG. 1B are that, at the stage where the radiation source container 10 is initially used, an attenuation plate 3 that attenuates the radiation passing therethrough to a preset amount of radiation is provided in the aperture B and, at the stage where the prescribed recommended period of use in regard to the welded seal of the radiation capsule 1 has reached the time where replacement is recommended, the capsule fixing member 2*a* and this attenuating plate 3 are removed, and the radiation source capsule is accommodated in a capsule cover 2*b* which is resealed by welding, before being again accommodated in the radiation source holder 4.

Figures 3A, 3B:
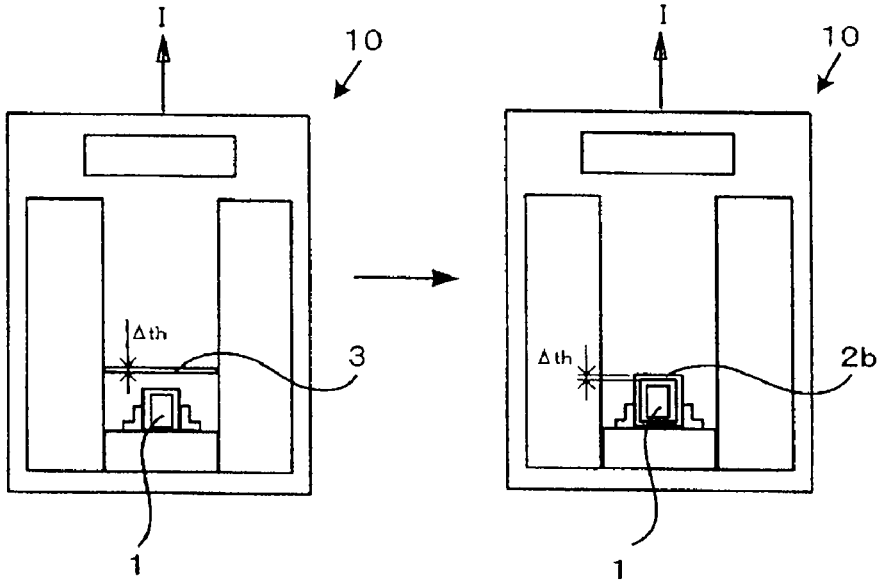
FIG. 3A, FIG. 3B, FIG. 3C, FIG. 3D and FIG. 3E are diagrams given in explanation of the principles of the present invention.
Figures 3C, 3D, 3E:
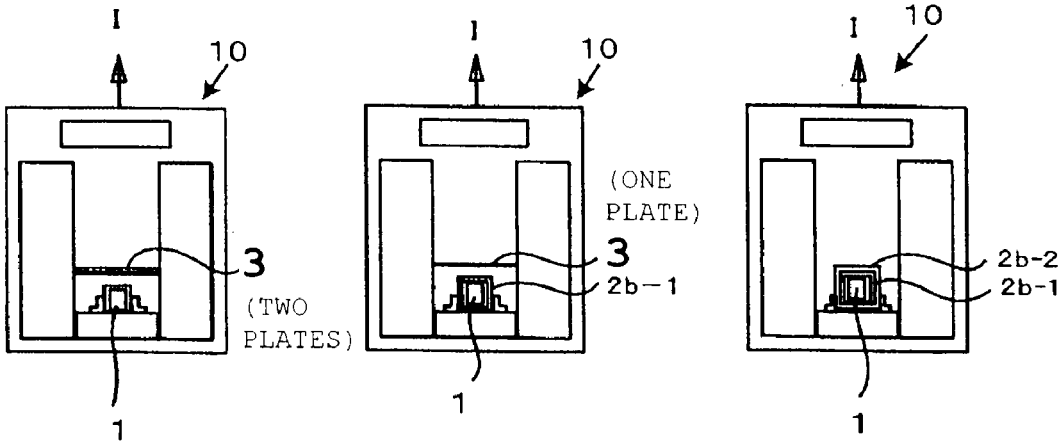
Figure 4:
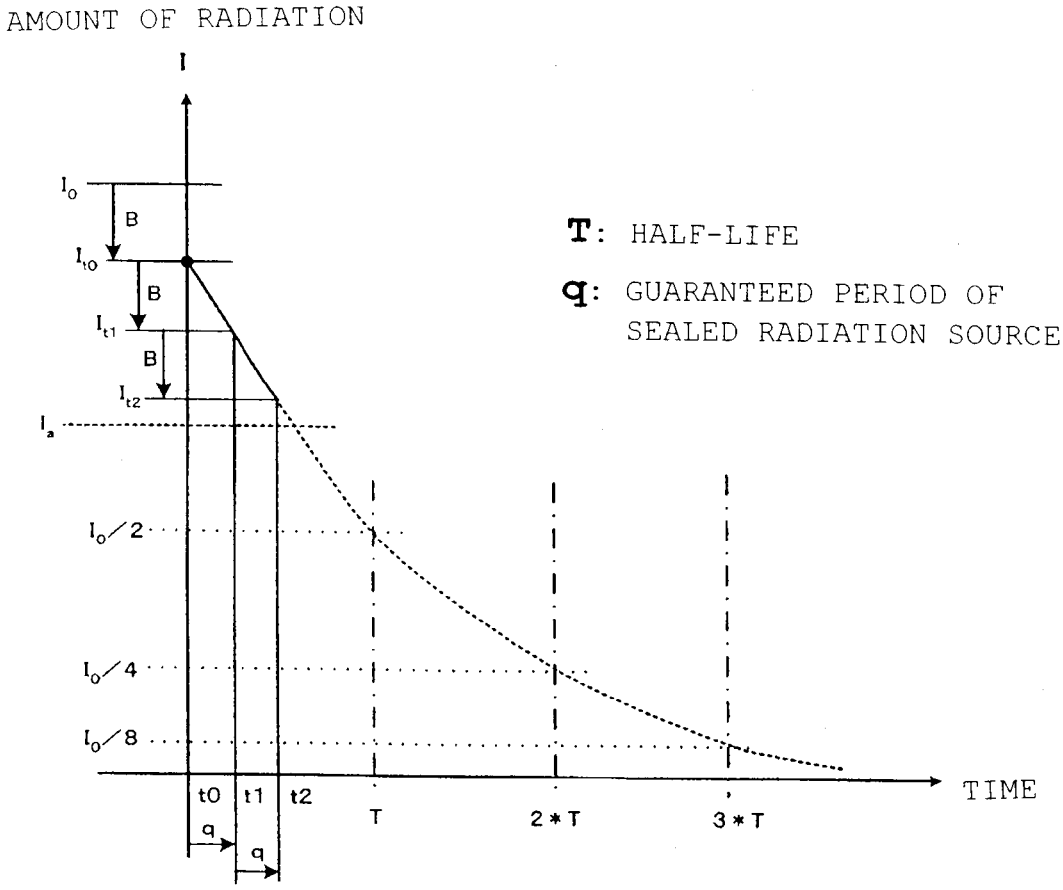
FIG. 4 is a view illustrating the action of the present invention.

Next, the principles of the present invention will be explained with reference to FIG. 3A, FIG. 3B, FIG. 3C, FIG. 3D and FIG. 3E and FIG. 4. FIG. 3B, FIG. 3C, FIG. 3D and FIG. 3E show a model view of a radiation source container 10 and FIG. 4 shows an example of the attenuation characteristic with time of the amount of radiation emitted from the radiation source capsule 1 during this period. When the attenuation plate 3 of thickness th, prescribed beforehand, is provided between the radiation port of the radiation source capsule 1 and the irradiation window of the radiation source container, the amount of radiation I emitted from the radiation source container is expressed by the following expression (1)

$$I=I_0 \cdot e^{-\mu \Delta t l} \cdot e^{-\lambda t} \quad (1)$$

where $I_0$ is the amount of radiation emitted when no attenuation plate 3 of FIG. 3A is present $\lambda$ is the decay constant of the sealed radiation source t is the time $\Delta$th is the thickness of the attenuation plate, and $\mu$ is the radiation absorption coefficient of the attenuation plate.

As shown in FIG. 4, when the half-life T of the sealed radiation source is sufficiently longer than the recommended period of use q for which sealing is maintained, the amount of attenuation of the initial amount of radiation $I_0$ at the time-point where the recommended period of use q has elapsed can be neglected. However, when the half-life T of the sealed radiation source is not sufficiently longer than the recommended period of use q for which sealing is maintained, the amount B of attenuation at the time-point where the recommended period of use q has elapsed cannot be neglected.

For example, if the amount of radiation that is required to be emitted from this sealed radiation source is Ia and an extended life of twice the recommended period of use q is to be guaranteed, it is necessary to satisfy:

$$I_{t2}=I_0\cdot e^{-\mu\Delta th}\cdot e^{-\lambda t2}\geqq Ia \quad (2)$$

Also, when set to the amount of attenuation B of the radiation produced by an attenuating plate 3 of thickness Δth, B is:

$$B=I_0\cdot e^{-\mu\cdot\Delta th} \quad (3)$$

Consequently, at the time point t2 where a period 2q of (t2−t0) has elapsed, if the necessary amount of radiation is to be guaranteed, it is necessary to guarantee that the initial value of the amount of radiation $I_0$ at the time-point t0 is:

$$I_0\geqq Ia+3B \quad (4)$$

Accordingly, if a radiation capsule 1 of radiation amount satisfying this expression (3) is provided, and the attenuating plate 3 is removed and resealing is effected by the capsule cover 2*b* of the same thickness Δt1 and the same material properties as the attenuating plate 3 at the time-point t1 of the recommended period of use q of this welded seal, the amount of radiation at the time-point t2 is $I_{t2}=I_0-2B$: thus, if the recommended period of use q of the welded seal of the resealed capsule cover 2*b* is about the same as or better than before, the recommended period of use q of this radiation source capsule 1 can be extended by a factor of two.

Since this capsule cover 2*b* is manufactured as an overlay, it is necessary to make the accommodation space of the radiation capsule 1 of the radiation source holder 4 larger by an amount corresponding to the number of times of resealing.

In this way, by selecting beforehand the sealed radiation taking into account the necessary period for which the amount of radiation is required and sealing with a specification equivalent to the recommended period of use q of the welded seal, the time required for a fresh evaluation of the extended life of the welded seal can be dispensed with, making it possible to achieve reliable extension of the life of the radiation capsule 1 in an effective fashion.

Hereinabove, the case where a single attenuating plate was provided was described. However, further, it would be possible, when extending the life of the sealed radiation source, to provide two such attenuating plates 3, and to arrange for one of these attenuating plates to be removed at the time-point where the recommended period of use q in regard to sealing performance is reached, resealing then being performed by a new capsule cover 2*b*-1; then, further, at the time-point where the recommended period of use q in regard to sealing performance is next reached, this second attenuating plate 3 is removed, and resealing is effected with a new capsule cover 2*b*-2.

Next, the capsule cover 2*b* and attenuating plate 3 constituted in accordance with the principles of the present invention explained above will be described. The capsule cover 2*b* constituted by a top capsule cover 2*b*1 and bottom capsule cover 2*b*2 is of a construction in which these can be easily mutually fitted by insertion, so that, when the radiation source capsule 1 is again accommodated, the weld-sealing operation can easily be performed.

Also, since the radiation source capsule 1 that is secured by welding sealing of stainless steel is of already-known material properties and thickness, its extended life in the environment in which it is to be used can be ascertained beforehand, as a database, for each type of measuring equipment using radiation. Consequently, life extension of high reliability can be achieved by weld-sealing with a capsule cover 2*b* of the same thickness and same material properties, and, in addition, by employing an attenuating plate 3 of the same material properties and thickness.

As described above, with the present invention, extension of life of the radiation source capsule can easily be achieved by providing an attenuating plate determined beforehand in accordance with the amount of radiation to be emitted, and repeatedly resealing a capsule cover of the same material properties and thickness as this attenuating plate.

The present invention is not restricted in any way to the embodiments described above and the attenuating plate and capsule cover, so long as they are provided between the irradiation window of the radiation source container and the radiation port of the sealed radiation source, and the same material properties and same thickness are selected, could be implemented with various suitable modifications of shape and material properties in accordance with the manufacturing specification of the sealed radiation source, within a scope not departing from the gist of the present invention.

What is claimed is:

1. A radiation source container that accommodates a radiation source, comprising:

a radiation source capsule;

a radiation source holder including an aperture that emits unidirectionally radiation emitted from a radiation port of said radiation source capsule, that provides screening such that no leakage of said radiation takes place except from said aperture, and that fixes said radiation source capsule in a manner that is difficult to attach or detach;

an irradiation window that transmits radiation emitted from said aperture;

an attenuation plate provided between said radiation port of said radiation source capsule and said irradiation window, that attenuates an amount of radiation emitted from said radiation source capsule prior to reaching said irradiation window;

a shutter provided between said attenuation plate and said irradiation window and that screens a radiation emitted from said irradiation window; and a capsule cover whereby, when a recommended use period in respect of a sealing performance of said radiation source capsule has expired, said attenuating plate is removed and said radiation port of said radiation source capsule is resealed with one having same material properties and same thickness as said removed attenuating plate, entirely covering said radiation source capsule.

2. The radiation source container according to claim 1, wherein said attenuating plate is provided on said radiation source capsule and thickness and material properties of said attenuating plate are equivalent to those of a sealing weld of said radiation source capsule.

3. A radiation source container said comprising:

a radiation capsule including a radiation port;

an attenuating plate that comprises:

a first capsule cover including a plurality of metal plates, wherein, when a recommended period of use in regard to sealing performance of said radiation source capsule has expired, one of said metal plates is removed and said radiation source capsule is entirely resealed with one having same material properties and same thickness as said one metal plate that was removed from said radiation port of said radiation source capsule; and a second capsule cover, wherein, when a guaranteed life in regard to sealing performance of said first capsule cover has expired, another one of said metal plates is removed and said first capsule cover is entirely resealed with one having same material properties and same thickness as said another one metal plate that was removed, so that said radiation source capsule can be reused a plurality of times.

4. A method of extending a sealing life of a radiation source capsule that seals a radiation source accommodated in a radiation source container, comprising:

providing an attenuating plate that produces attenuation beforehand so as to present a value corresponding to an amount of attenuation of an amount of radiation emitted from said radiation source capsule of said radiation source container in a recommended period of use of sealing said radiation capsule; and removing said attenuating plate and resealing a radiation port of said radiation source capsule with one having same material properties and same thickness as said removed attenuating plate so as to cover said radiation source capsule entirely, when a recommended use period in respect of the sealing performance of said radiation source capsule has expired.

* * * * *